US008018157B2

(12) United States Patent
Arndt et al.

(10) Patent No.: US 8,018,157 B2
(45) Date of Patent: Sep. 13, 2011

(54) LAMP WITH A BASE AT ONE END

(75) Inventors: Joachim Arndt, Brieselang (DE); Uwe Fidler, Berlin (DE); Ralph Hauschild, Beelitz (DE)

(73) Assignee: Osram AG, Munich (DE)

( * ) Notice: Subject to any disclaimer, the term of this patent is extended or adjusted under 35 U.S.C. 154(b) by 21 days.

(21) Appl. No.: 12/575,545

(22) Filed: Oct. 8, 2009

(65) Prior Publication Data

US 2010/0090600 A1 Apr. 15, 2010

(30) Foreign Application Priority Data

Oct. 10, 2008 (DE) ..... 20 2008 013 506 U

(51) Int. Cl.
*H01J 17/16* (2006.01)

(52) U.S. Cl. ..... 313/634; 313/635

(58) Field of Classification Search ..... 313/634–636
See application file for complete search history.

(56) References Cited

U.S. PATENT DOCUMENTS

| | | | |
|---|---|---|---|
| 4,490,642 A | 12/1984 | Dobrusskin et al. | |
| 7,439,662 B2 | 10/2008 | Arndt et al. | |
| 7,741,779 B2 | 6/2010 | Takeda et al. | |
| 2007/0182333 A1 * | 8/2007 | Kakisaka et al. | 313/634 |

FOREIGN PATENT DOCUMENTS

| | | | |
|---|---|---|---|
| DE | 3129329 | A1 | 2/1983 |
| EP | 1763066 | A1 | 3/2007 |
| EP | 2031636 | A1 | 3/2009 |
| WO | 2005015605 | A2 | 2/2005 |
| WO | 2007139058 | A1 | 12/2007 |

* cited by examiner

*Primary Examiner* — Anne Hines

(57) ABSTRACT

Various embodiments provide an electric high-pressure lamp with a base at one end, with a wattage of at most 100 W and with a discharge vessel which is sealed in a vacuum-tight manner, said discharge vessel being surrounded by an inner bulb and furthermore by an outer bulb, a base with electrical terminals supporting the outer bulb on one side and the inner bulb on the other side, wherein an effective axial length of the inner bulb is defined as the length of said inner bulb without the ends, with the following geometrical relations with respect to the length being maintained: the volume VH of a hollow cylinder extending between the inner bulb and the outer bulb is given by $8\,cm^3 \leqq VH \leqq 15\,cm^3$; the impact quality IG, defined as the product of the clear width between the inner bulb and the outer bulb and the square of the wall thickness of the outer bulb, in each case calculated in mm, is at least 8 $mm^3$, with the result that the following applies: $8 \leqq IG$.

10 Claims, 3 Drawing Sheets

LAMP WITH A BASE AT ONE END

CROSS-REFERENCE TO RELATED APPLICATION

This application claims priority to German Utility Model Serial No. 20 2008 013 506.0, which was filed Oct. 10, 2008, and is incorporated herein by reference in its entirety.

TECHNICAL FIELD

Various embodiments relate to a lamp with a base at one end. Various embodiments provide high-pressure discharge lamps, e.g. metal-halide lamps. In this case, an elongated, ceramic discharge vessel may be provided in various embodiments.

BACKGROUND

EP-A 1 763 066 discloses a lamp with a base at one end which is constructed from three bulbs. It describes as key parameters an outer diameter of the outer bulb of a maximum of 25 mm and, as a minimum value, a value which is based on the power of the lamp. Furthermore, said document finds a minimum value of 9 mm for the outer diameter of the inner bulb and a ratio between A and B of at least 1.14 to be essential for low-wattage lamps with a power of between 20 and 130 W.

SUMMARY

Various embodiments provide a lamp with a base at one end, which may realize, in an elegant manner, protection against explosion and thermal resistance for low-wattage lamps e.g. in a range of from 15 to 100 W.

Various embodiments provide an electric high-pressure lamp with a base at one end, with a wattage of at most 100 W and with a discharge vessel which is sealed in a vacuum-tight manner, said discharge vessel being surrounded by an inner bulb and furthermore by an outer bulb, a base with electrical terminals supporting the outer bulb on one side and the inner bulb on the other side, wherein an effective axial length of the inner bulb is defined as the length of said inner bulb without the ends, with the following geometrical relations with respect to the length being maintained: the volume VH of a hollow cylinder extending between the inner bulb and the outer bulb is given by $8\ cm^3 \leqq VH \leqq 15\ cm^3$; the impact quality IG, defined as the product of the clear width between the inner bulb and the outer bulb and the square of the wall thickness of the outer bulb, in each case calculated in mm, is at least 8 $mm^3$, with the result that the following applies: $8 \leqq IG$.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
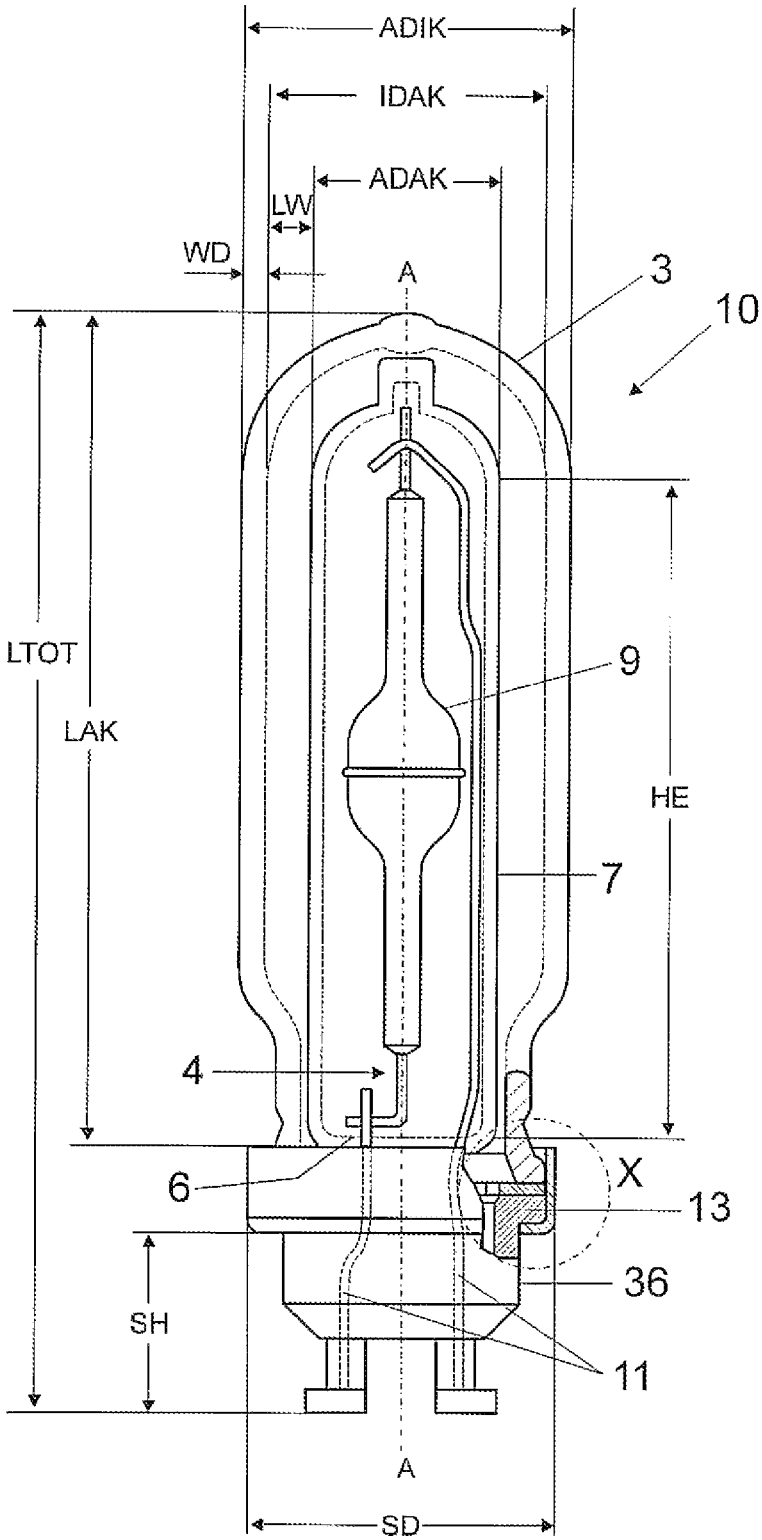
FIGS. 1 and 1A show a metal-halide lamp with an inner bulb and an outer bulb.
Figure 1A:
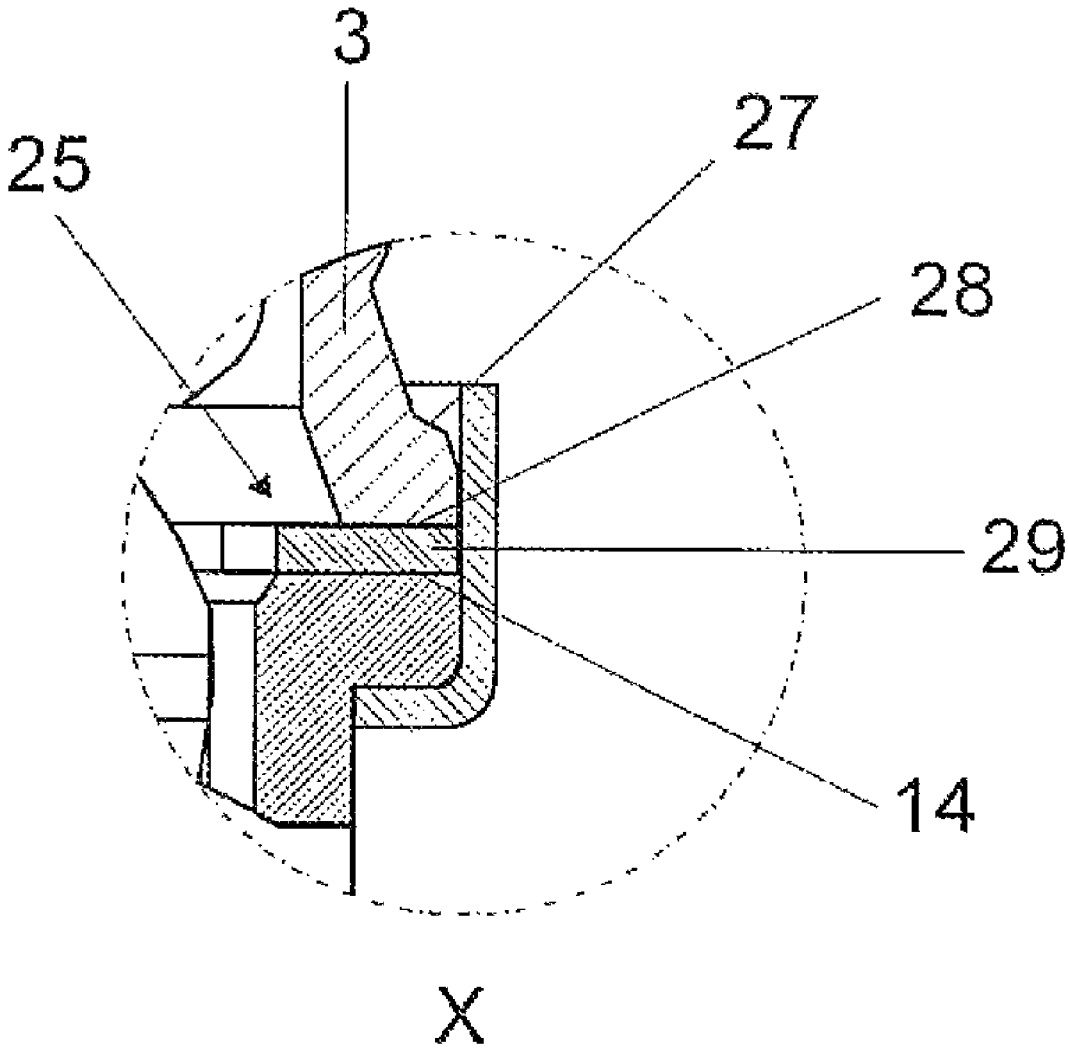

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The rapidly developing luminaire market for metal-halide lamps demands increasingly compact, i.e. small in terms of diameter and length, and at the same time explosion-proof lamps, which can be operated in open luminaires. By virtue of special solutions in the base/lampholder sector, relatively small dimensions can be achieved in comparison with screw-type bases. The risk with miniaturization, however, consists in the thermal overloading of the critical processing zones, such as the fuse seals, for example. This is particularly the case when using ceramic burners. Various embodiments provide explosion-proof discharge lamps with two outer bulbs in the power range of between 15 and 100 W.

It has been shown that modular lamps, e.g. high-pressure discharge lamps, e.g. those having a ceramic discharge vessel, require there to be as little thermal loading of the fuse seals of the discharge vessel as possible. In this case, it may be provided in various embodiments to start with a two-ended discharge vessel made from ceramic. At the same time, a factor with such lamps is optimum protection against explosion.

The lamp with a base at one end has a lamp bulb which is sealed in a vacuum-tight manner, in particular an elongated discharge vessel which is also accommodated in a bulb, this lamp bulb, i.e. overall the structural unit including the discharge vessel with the inner bulb, also being surrounded by an enveloping part, what is referred to here as the outer bulb. In various embodiments, the discharge vessel is a ceramic discharge vessel, e.g. for a metal-halide lamp, for example for general lighting purposes. In this case, a base with electrical terminals supports the inner bulb on one side and the outer bulb on the other side. The electrical terminals are normally connected to power supply lines, which produce electrical contact with a light-emitting means in the interior of the lamp bulb, for example the light-emitting means is realized by electrodes or a light-emitting element of an incandescent lamp. A discharge vessel made from quartz glass or hard glass can also be used instead of a ceramic discharge vessel, for example at relatively high wattages.

In practice it has been shown that, in the case of such lamps with a low wattage, the thermal loading, on the one hand, and the explosion protection, on the other hand, are two contradictory demands. The reason for this is the fact that the effective volume in the outer bulb should be kept within an optimum range, which can counteract the thermal loading. In this case, in various embodiments, effective volume VH is intended to mean a volume which relates to the undisrupted inner bulb, i.e. its axial effective length HE without the end structure. Included in the end structure are firstly the coupling and secondly the pinch seal or other seal at the inner bulb. Correspondingly, the volume of the outer bulb only in the region HE is also taken into consideration.

At average wattages, typically 70 W, it may be important for thermal reasons for the inner bulb to be filled with nitrogen ($N_2$) or a similar inert gas, to be precise with a coldfilling pressure of approximately 300 to 850 mbar. However, the inner bulb can also be evacuated, in particular at relatively low wattages of up to at most 35 W.

Secondly, the volume VH of the hollow cylinder which is positioned between the outer bulb and the inner bulb and extends over a height of HE should be in an optimum range of at least 8 and at most 15 $cm^3$:

$8 \leqq VH \leqq 15$ [$cm^3$].

This value, as a rough approximation, is independent of the power as long as the power fluctuates in the range of from 15 to 100 W, for example of from 15 to 70 W. As the wattage increases, this value may tend to orientate in the direction of the upper limit value. If the volume of the hollow cylinder is less than 8 $cm^3$, a sufficient life of at least 2000 hours cannot be achieved since the fuse seals lose their seal-tightness under the thermal loading. If the volume is greater than 15 $cm^3$, the lamp overall remains too cool.

At the same time, however, it has been shown that protection against explosion is only sufficiently reliable when the clear width LW, that is the distance between the inner bulb and the outer bulb, is sufficiently large taking into consideration the wall thickness WD of the outer bulb, which must ultimately absorb the energy of the fragments of glass in the event of breakage of the inner bulb. A characteristic, the impact quality IG, can be defined for this, and this characteristic results from the product of the clear width LW (in mm) and the square of the wall thickness WD of the outer bulb (WD likewise in mm). Practical tests have shown that this value for the impact quality should be at least 8 $mm^3$:

$8 \leqq IG$ [$mm^3$].

By way of example, the variable VH is matched to the variable IG in such a way that it is in a range which is limited by the following boundary values:

$500\ IG \leqq VH \leqq 1100\ IG$ [$mm^3$].

Since the impact quality is dependent on a distance between the inner bulb and the outer bulb which is as great as possible, but an optimum volume of the hollow cylinder between the inner bulb and the outer bulb needs to be attained in the case of thermal loading, it is important to reduce the physical length of the lamp as far as possible in order to nevertheless achieve sufficient protection against explosion in the case of an optimum volume VH of the effective hollow cylinder. The volume of the hollow cylinder is in this case filled with air or $N_2$ or another inert gas at approximately atmospheric pressure.

The stability of the outer bulb is at its greatest when it is cylindrical in the region of HE. However, it is not impossible for the outer bulb to have a bulging configuration. In this case, the minimum values of the above-described variables are used in each case.

A typical application is a metal-halide lamp with a ceramic discharge vessel which contains a fill with or without a mercury component, possibly with an inert starting gas, for example a noble gas.

In the present case, of particular interest is a compact discharge lamp with the following geometry:

total length LTOT of a maximum of 86 mm, calculated from the base lower edge to the bulb end;

typical outer diameter ADAK of the outer bulb is from 20 to 28 mm;

shortened base owing to the use of a special bayonet-type base;

outer diameter of the base in the region of the outer diameter of the outer bulb, typically from 20 to 28 mm, for example from 26 to 28 mm;

base height SH typically from 16 to 20 mm, for example 18 mm;

wall thickness WD of the outer bulb at least 1.4 mm, for example in the range of from 1.6 to 2.0 mm, a typical value is 1.8 mm.

Burning duration tests, during freely burning operation, have demonstrated an increased failure rate in the case of the prior art, especially at 70 W, starting from 2500 h. In the case of increasingly narrow lamp enclosures as are found in compact luminaires, this effect can be exacerbated. In this case, in addition to the back-reflection of the glass surface of the outer bulb and of reflector surfaces of the luminaire, the lack of cooling effect as a result of convection (in comparison with freely burning lamps) also plays a decisive role.

Widening the outer diameter of the outer bulb ADAK to values $\geqq 26$ mm influences the thermal states, as described above, in a particularly positive manner. In this case, the ratio VAL of the outer diameter ADAK of the outer bulb to the total length of the lamp LTOT should be in the region of $VAL \geqq 0.29$.

In order to be able to realize a short physical length, the ratio VS of the maximum base length SH to the base diameter SD should be in the region of $VS \leqq 0.9$.

In the event of the discharge vessel in the inner bulb bursting, it is possible for the inner bulb to be considerably damaged. In this case, the energy of the glass/ceramic parts accelerated in the direction of the outer bulb needs to be absorbed by said outer bulb. In this case, the outer bulb should not be damaged. The clear width LW between the inner bulb and the inner surface of the outer bulb is in this case an important parameter in combination with the wall thickness of the outer bulb. The ratio VDU of the outer diameter ADIK of the inner bulb to the inner diameter IDAK of the outer bulb should be $VDU \leqq 0.7$.

The wall thickness WD of the outer bulb is at least 1.4 mm and is for example in the range of from 1.6 mm to 2.0 mm.

An exemplary embodiment of a metal-halide lamp 10 is shown in FIG. 1. A ceramic discharge vessel 9, which is sealed at two ends, is arranged extending longitudinally in the lamp axis A and is surrounded closely by an inner bulb 7, which is provided with a pinch seal at one end and is manufactured from quartz glass. This basic lamp is also surrounded by an outer bulb 3. A frame 4 with a short and a long feed line holds the discharge vessel 9 in the inner bulb 7. The electrodes in the interior of the discharge vessel are connected to the feed lines via leadthroughs (not shown). Said feed lines are connected to outer power supply lines 11 in the region of a pinch seal 6, which seals the inner bulb 7. The pinch seal 6 of the inner bulb rests (not shown) in a matching opening of a base insulator made from ceramic and is held, for example, by means of a metal clip or by means of crimping. This opening is surrounded by a central collar part 13. Said central collar part protrudes out of a plane defined by a cylindrical outer rim, on which the outer bulb made from hard glass is held. The outer bulb opens out into a bayonet-type base 36.

The outer bulb 3 is equipped at its opening 25 with a radially projecting rim 27. It has a flat, lower contact surface 28, which is matched to the upper plateau 14 of the segment of the base insulator. An elastomer ring 29, for example made from Viton®, under certain circumstances rests on said lower contact surface (see in this regard WO 2005015605).

A 20 W lamp with a metal-halide fill has an outer diameter ADM of the inner bulb of 15 mm, an outer diameter of the outer bulb ADAK of 26 mm and a wall thickness WD of the outer bulb of 1.8 mm. The total length LTOT of the entire lamp is only 86 mm. The length LAK of the outer bulb, calculated from the attachment point of the base, is 68 mm. The effective length HE of the inner bulb is 51 mm. The base height SH is 18 mm, the diameter SD of the base is 22 mm.

The clear width LW between the inner bulb and the outer bulb in the region of HE is 3.7 mm.

The volume of the hollow cylinder over the effective length HE, between the inner bulb and the outer bulb, is approximately 11 080 $mm^3$. The impact quality is 12.0 $mm^3$.

In the case of a 15 W lamp, the following values apply: said lamp has an outer diameter of the inner bulb of 13 mm, an outer diameter of the outer bulb of 26 mm and a wall thickness WD of the outer bulb of 1.8 mm. The total length of the entire lamp is only 49 mm. The length of the outer bulb, calculated from the point at which the base is attached, is 68 mm. The effective length HE of the inner bulb is 37 mm. The base height is 18 mm and the diameter of the base is 22 mm. The clear width LW between the inner bulb and the outer bulb in the region of HE is 4.7 mm.

The volume of the hollow cylinder over the effective length HE, between the inner bulb and the outer bulb, is approximately 9600 $mm^3$. The impact quality is 15.2 $mm^3$.

In various embodiments, the inner bulb may be made from quartz glass and the outer bulb is made from hard glass. In principle, however, both materials can be used for both bulbs, depending on the thermal loading in accordance with various embodiments.

In contrast, a lamp which is on the market, Matsushita Premia S, with 20 W demonstrates the following characteristic data:

The lamp has an outer diameter of the inner bulb of 15 mm, an outer diameter of the outer bulb of 20.5 mm and a wall thickness WD of the outer bulb of 1.5 mm. The total length of the entire lamp is 114 mm. The length of the outer bulb, calculated from the point at which the base is attached, is 87 mm. The effective length HE of the inner bulb is 65 mm. The base height is 26 mm and the diameter of the base is 22 mm. The clear width LW between the inner bulb and the outer bulb in the region of HE is 1.25 mm. The volume of the hollow cylinder over the effective length HE, between the inner bulb and the outer bulb, is approximately 4162 $mm^3$. The impact quality is 2.8 $mm^3$. This lamp tends to have a short life and a low degree of protection against explosion since neither the optimum volume nor the optimum impact quality is achieved.

Figure 2:
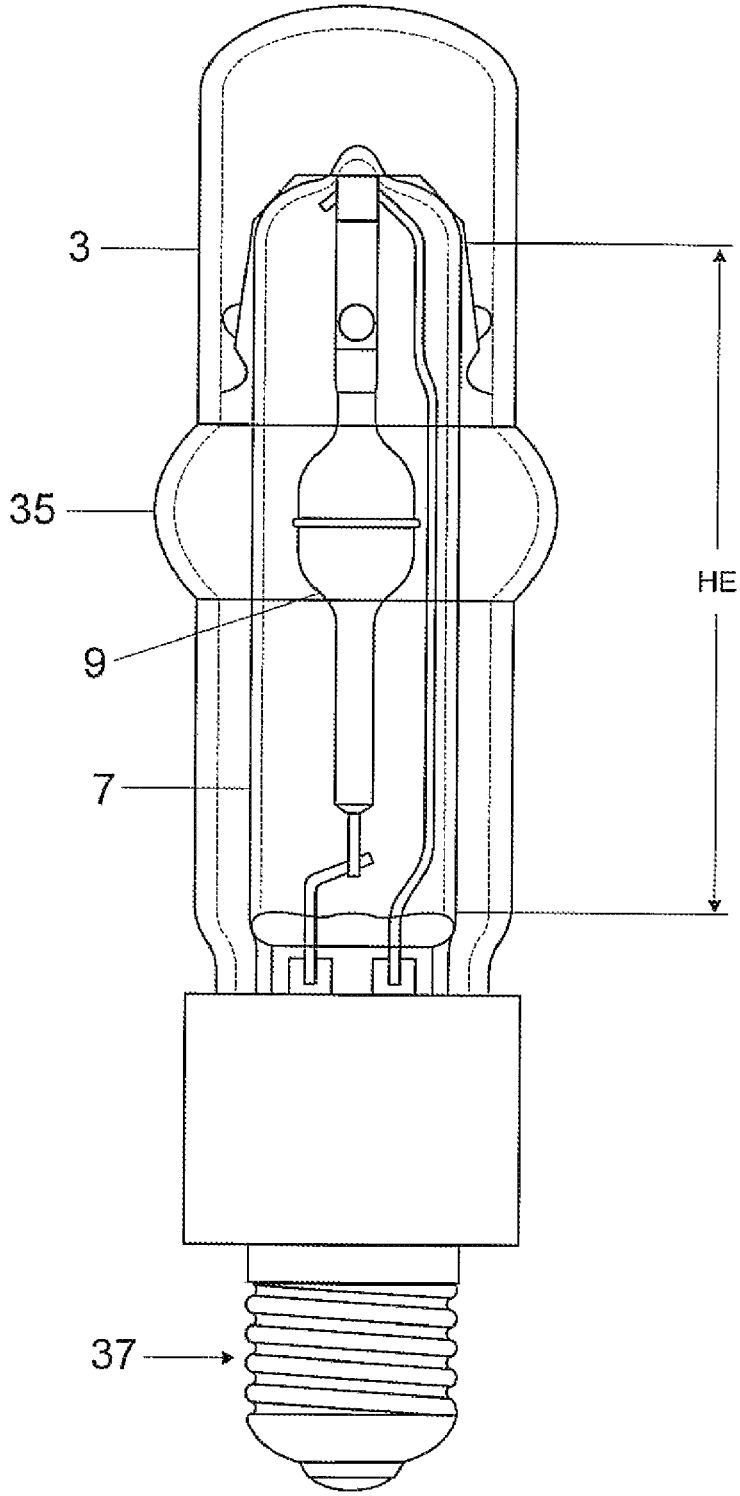
FIG. 2 shows a further exemplary embodiment with a bulging outer bulb.

A further exemplary embodiment of a metal-halide lamp is shown in FIG. 2. In this exemplary embodiment, the outer bulb 3 is configured so as to have a bulge 35. The values discussed above apply in this case in the sense of the minimum value for the diameter and clear width. This exemplary embodiment uses a screw-type base 37.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An electric high-pressure lamp with a base at one end, with a wattage of at most 100 W and with a discharge vessel which is sealed in a vacuum-tight manner, said discharge vessel being surrounded by an inner bulb and furthermore by an outer bulb, a base with electrical terminals supporting the outer bulb on one side and the inner bulb on the other side, wherein an effective axial length of the inner bulb is defined as the length of said inner bulb without the ends, with the following geometrical relations with respect to the length being maintained: the volume VH of a hollow cylinder extending between the inner bulb and the outer bulb is given by $8\ cm^3 \leqq VH \leqq 15\ cm^3$;

the impact quality IG, defined as the product of the clear width between the inner bulb and the outer bulb and the square of the wall thickness of the outer bulb, in each case calculated in mm, is at least 8 $mm^3$, with the result that the following applies: $8 \leqq IG$.

2. The electric lamp with a base at one end as claimed in claim 1, wherein the volume VH is selected such that the following applies: $500\ IG \leqq VH \leqq 1100\ IG$.

3. The electric lamp with a base at one end as claimed in claim 1, wherein the inner bulb is manufactured from quartz glass and the outer bulb is manufactured from hard glass.

4. The electric lamp with a base at one end as claimed in claim 1, wherein the discharge vessel is manufactured from ceramic.

5. The lamp as claimed in claim 1, wherein the lamp has a low wattage in the range of from 15 to 100 W.

6. The lamp as claimed in claim 1, wherein the inner bulb is filled with inert gas or evacuated.

7. The lamp as claimed in claim 1, wherein the wall thickness is in the range of from 1.4 to 2.0 mm.

8. The lamp as claimed in claim 1, wherein the following applies for the ratio VS of the base height to the base diameter: $VS \leqq 0.9$.

9. The lamp as claimed in claim 1, wherein the following applies for the ratio VDU of the outer diameter of the inner bulb to the inner diameter of the outer bulb: $VDU \leqq 0.7$.

10. The lamp as claimed in claim 1, wherein the following applies for the ratio VAL of the outer diameter of the outer bulb to the total length of the lamp: $VAL \leqq 0.29$.

* * * * *

UNITED STATES PATENT AND TRADEMARK OFFICE

CERTIFICATE OF CORRECTION

PATENT NO. : 8,018,157 B2
APPLICATION NO. : 12/575545
DATED : September 13, 2011
INVENTOR(S) : Arndt et al.

It is certified that error appears in the above-identified patent and that said Letters Patent is hereby corrected as shown below:

In claim 10 please correct line 48 to read as follows:

"VAL≥0.29"

Signed and Sealed this
Fifteenth Day of November, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,018,157 B2
APPLICATION NO. : 12/575545
DATED : September 13, 2011
INVENTOR(S) : Arndt et al.

It is certified that error appears in the above-identified patent and that said Letters Patent is hereby corrected as shown below:

Column 6, line 48 (Claim 10, line 3) please correct to read as follows:

"VAL≥0.29"

This certificate supersedes the Certificate of Correction issued November 15, 2011.

Signed and Sealed this
Twentieth Day of December, 2011

David J. Kappos

David J. Kappos
*Director of the United States Patent and Trademark Office*